US006523526B2

(12) United States Patent
Schwarz

(10) Patent No.: US 6,523,526 B2
(45) Date of Patent: Feb. 25, 2003

(54) METHOD FOR OPERATING A DIESEL ENGINE WITH A PUMP-LINE-NOZZLE INJECTION SYSTEM

(75) Inventor: Volker Schwarz, Weinstadt (DE)

(73) Assignee: Daimler Chrysler AG, Stuttgart (DE)

( * ) Notice: Subject to any disclaimer, the term of this patent is extended or adjusted under 35 U.S.C. 154(b) by 26 days.

(21) Appl. No.: 09/825,378

(22) Filed: Apr. 2, 2001

(65) Prior Publication Data

US 2001/0027778 A1 Oct. 11, 2001

(30) Foreign Application Priority Data

Apr. 5, 2000 (DE) ..... 100 17 060

(51) Int. Cl.[7] ..... F02M 37/04
(52) U.S. Cl. ..... 123/506; 123/500; 123/496
(58) Field of Search ..... 123/506, 496, 123/456, 500, 501

(56) References Cited

U.S. PATENT DOCUMENTS 4,881,504 A * 11/1989 Best ..... 123/447
5,345,916 A * 9/1994 Amann et al. ..... 123/506
6,167,870 B1 * 1/2001 Sakasai ..... 123/500
6,237,573 B1 * 5/2001 Onishi et al. ..... 123/506
6,386,185 B1 * 5/2002 Cooke ..... 123/506

FOREIGN PATENT DOCUMENTS

DE 38 01 929 8/1988
WO WO 97/01031 1/1997

* cited by examiner

*Primary Examiner*—Carl S. Miller
(74) *Attorney, Agent, or Firm*—Klaus J. Bach

(57) ABSTRACT

In a method for operating a Diesel engine with a pump-line-nozzle injection system, which allows the pressure level to be raised in the lower and intermediate engine speed ranges in relation to a predetermined maximum permissible injection pressure without this maximum permissible injection pressure being exceeded in the upper engine speed range by providing an injection pump designed to deliver the desired fuel injection pressure at low and intermediate engine speeds and including a pressure relief valve in the fuel injection line permitting limiting of the fuel injection pressure at higher engine speeds.

7 Claims, 4 Drawing Sheets

METHOD FOR OPERATING A DIESEL ENGINE WITH A PUMP-LINE-NOZZLE INJECTION SYSTEM

BACKGROUND OF THE INVENTION

The invention relates to a method for operating a Diesel engine with a pump-line-nozzle injection system including means for controlling the fuel pressure in the pump-line-nozzle system.

Diesel engines operating with pump-line-nozzle injection systems are known in the art. Because each individual cylinder has its own injection unit comprising a pump, a fuel supply line, a nozzle and a pump which is driven by the camshaft of the internal combustion engine and is arranged close to the nozzle, the fuel supply lines are only short and can withstand very high injection pressures well into the range of 1000 bar and above. This is achieved with a design, in which the highest injection pressure occurs at the rated speed and full load, for which the design parameters of the system such as cam velocity, diameter of the pump plunger and flow cross-section of the injection nozzle are chosen and which are critical in this respect. At lower engine speeds and lower engine loads, the injection pressures fall substantially. The pressure profile obtained over the engine speed is roughly triangular with a flank that rises more gently toward the maximum pressure.

Pumps for pump-line-nozzle injection systems of this kind are known for example from WO 97/01 031. In this known pump design, the pump is provided with a delivery-side control valve that allows a modification of the shape of the pressure profile curve to lower the pump pressure by discharging fuel to the low-pressure side.

It is the object of the present invention to provide a method for operating a Diesel engine with a pump-line-nozzle injection system by which soot and particulate emissions of the Diesel engine are reduced, especially in the intermediate and lower engine-speed and load range.

SUMMARY OF THE INVENTION

In a method for operating a Diesel engine with a pump-line-nozzle injection system, which allows the pressure level to be raised in the lower and intermediate engine speed range in relation to a predetermined maximum permissible injection pressure without this maximum permissible injection pressure being exceeded in the upper engine speed range by providing an injection pump designed to deliver the desired fuel injection pressure at low and intermediate engine speeds and including a pressure relief valve in the fuel injection line permitting limiting of the fuel injection pressure at higher engine speeds.

With the present invention, the level of the engine speed-dependent pressure is increased in the intermediate and lower engine speed and load range, in particular by designing the system for a theoretical pressure point that is above the rated speed/full load point and the corresponding maximum permissible injection pressure. In this way a pressure profile curve is obtained, whose level is higher overall, but which is lowered by opening the control valve in the region of critical values, i.e. when or before the maximum permissible injection pressure is exceeded.

With the method according to the invention, a relatively high degree of flexibility is achieved in the definition of the pressure profile curve without the need for changing the mechanics of the system. The disadvantages associated normally with a design providing for a higher-pressure level, including that of a higher power requirement, do not take effect. In the lower engine speed ranges, the increase in pressure is desired and mechanically acceptable and in the critical upper speed range, the pressure is limited because excess pressure is released through a short circuit to the low-pressure side. As a result, there is no significant rise in the power requirement apart from pumping losses.

Within the context of the invention, it is possible to adjust the pressure profile even before thy pressure corresponding to the maximum permissible injection pressure is reached if a pressure increase is desired only in the lower speed range.

Further details and features of the invention will become apparent from the following description of one exemplary embodiment of the invention described below with reference to the accompanying drawings:

DESCRIPTION OF PREFERRED EMBODIMENTS

Figure 1:
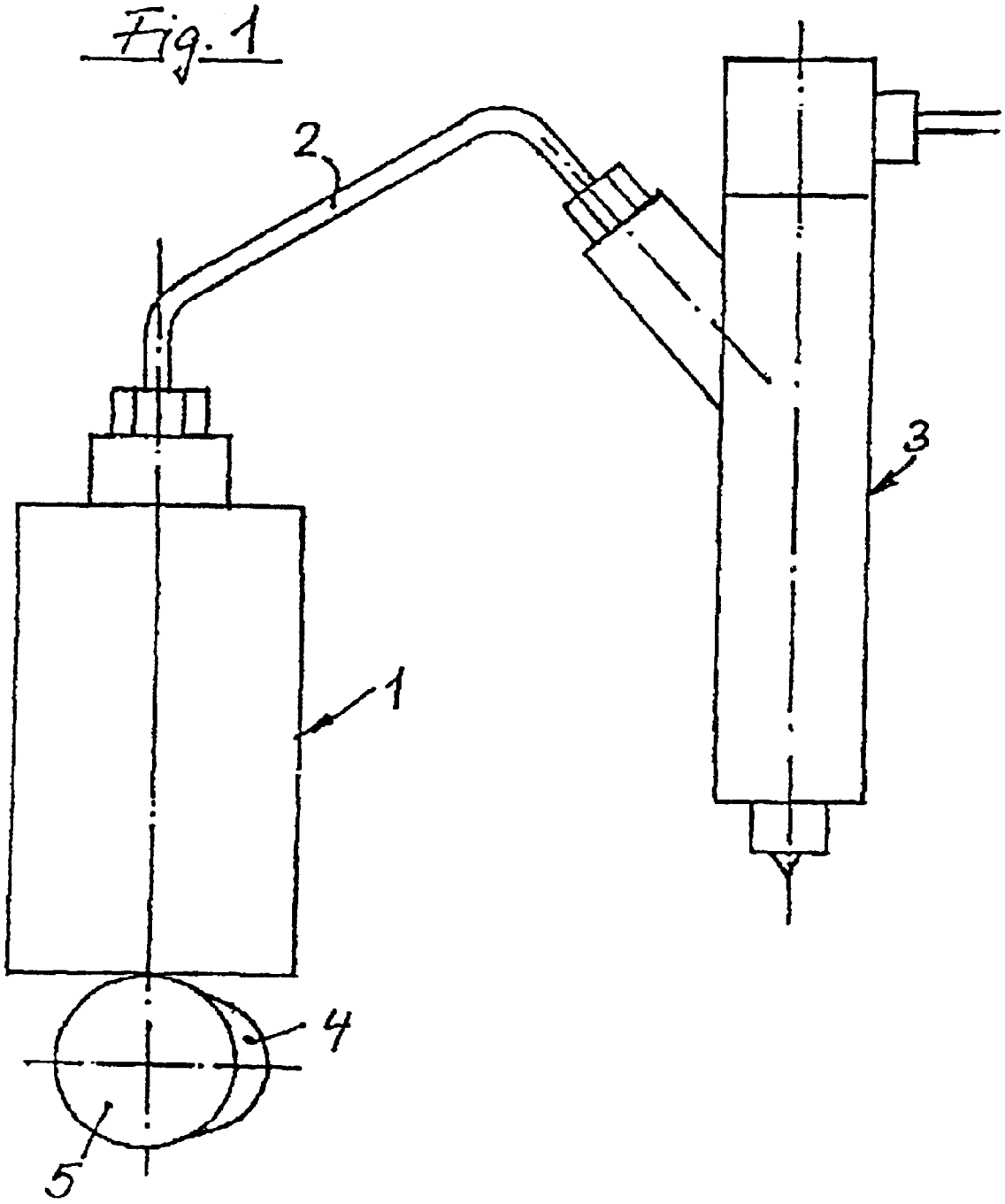
FIG. 1 is a schematic representation of a pump-line-nozzle injection system for a Diesel engine, which is not shown specifically.

FIG. 1 shows a pump-line-nozzle injection system for Diesel engines, including a pump denoted by the numeral 1, a fuel supply line by the numeral 2 and a nozzle by the numeral 3. The pump 1, the line 2 and the nozzle 3 form an injection unit, of which one is associated with each cylinder of the internal combustion engine. The pump 1 is generally in the form of a plug-in pump mounted in the cylinder head or in the area close to the cylinder head of the engine (not shown specifically). It is operated by a cam 4 of the camshaft 5, which preferably also performs the function of a timing camshaft for the intake and exhaust valves of the internal combustion engine. The injection end of the nozzle 3 is disposed in the combustion chamber of a cylinder in a manner well known in the art.

A pump-line-nozzle injection system of this kind is generally designed for the rated-speed/full-load load point of a Diesel internal combustion engine. The injection pressures that occur here correspond approximately to the maximum permissible injection pressure. Since the injection pressure is dependent on the engine speed, the injection pressures obtained at lower engine speeds are correspondingly lower. This can have a disadvantageous effect on fuel atomization.

To counteract this effect, the pump line-nozzle injection system is configured, with regard to the variables that define the injection criteria, in particular the cam velocity, the diameter of the pump plunger and the flow cross-section of the nozzle, for a theoretical load point which would result in injection pressures that exceed the maximum permissible injection pressure of the system. It is therefore possible to achieve a pressure profile, plotted over engine speed, that is at a higher level than the pressure profile designed rated-speed/full-load load point and thus also results in higher injection pressures in the range in which such a higher pressure profile can be utilized.

Figure 3:
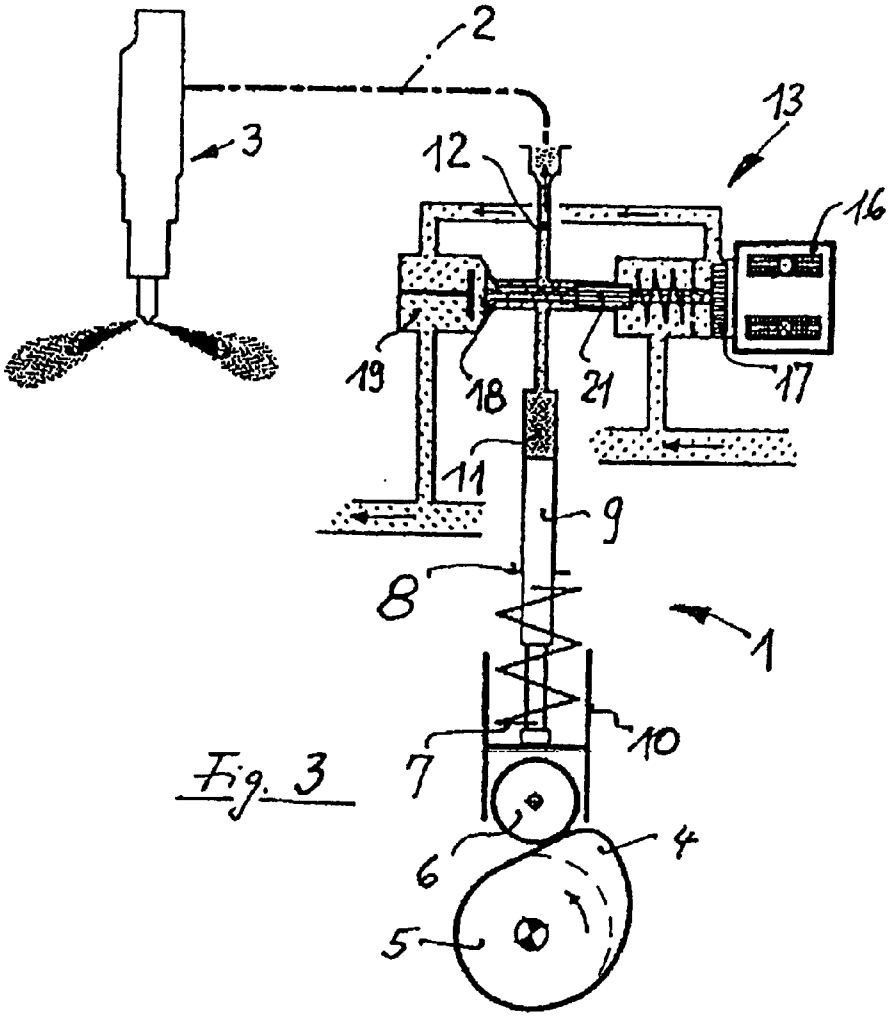
FIGS. 2 and 3 are diagrammatic representations of an injection system, including a control valve arranged downstream of the pump. The spring-biased valve is shown in FIG. 2 in an open position and in FIG. 3 in a solenoid-actuated closed position.
Figure 2:
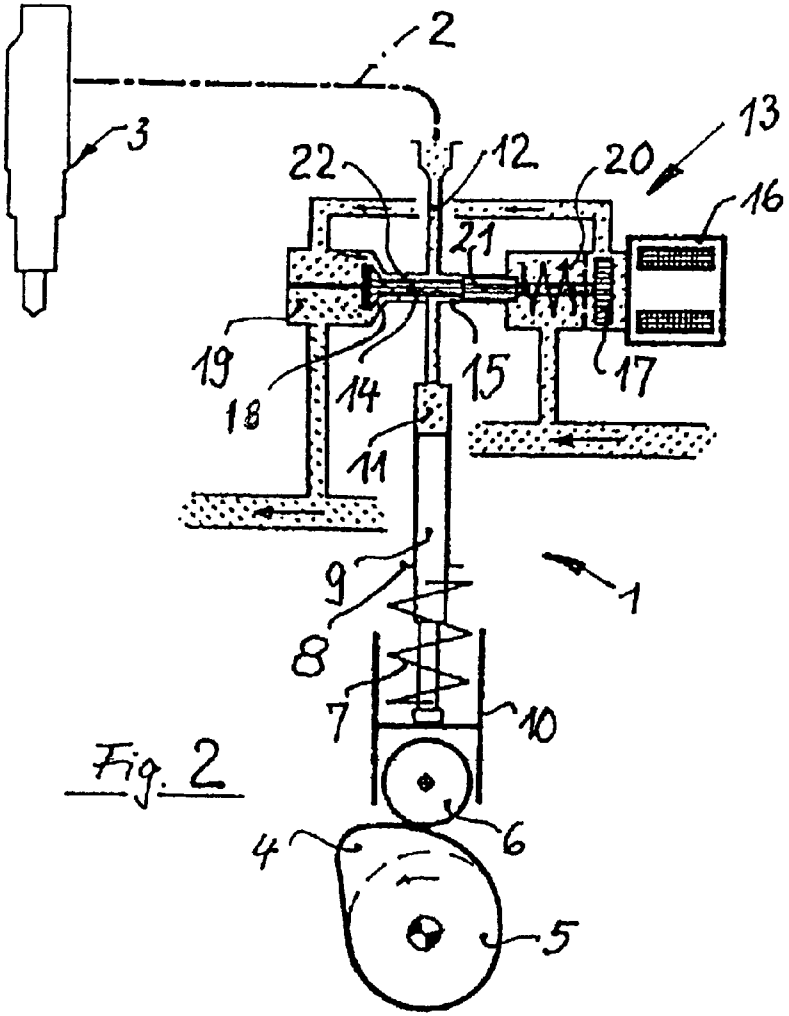

In accordance with the invention, the higher achievable fuel pressure is utilized in the lower and intermediate engine speed range, but not in the upper engine speed range, in which the theoretical configuration for a load point above the maximum permissible injection pressure would lead to impermissibly high delivery and injection pressures. For this critical load range, the level of the engine speed-dependent pressure profile is accordingly reduced by reducing the delivery pressure of the pump in a controlled manner by bypassing it to the low-pressure side. The bypass is controllable and is preferably formed by a control valve designed as a solenoid valve. FIGS. 2 and 3 show the relevant aspects of the design of the injection system, the pump, the line and the nozzle being designated again by the numerals 1, 2, and 3, respectively.

The pump 1 is driven by means of its cam follower roller 6, which interacts with the cam 4 of the camshaft 5 and which is supported by a sliding guide structure 10. The sliding guide structure 10 and the pump housing 8 are shown only schematically. The sliding guide structure 10 with the cam follower roller 6 is supported resiliently relative to the pump housing 8 by a spring 7. The sliding guide structure 10 acts on the pump plunger 9, which is guided in the pump housing 8. The pump plunger 9 delimits a pressure space 11, which is connected to the line 2, the zone of transition to the line 2 being formed by a line section 12 in which the control valve 13 is arranged.

The control valve 13 is designed in a customary manner as a solenoid valve and has a stem part 14 that extends transversely to the line section 12. It is guided in a housing part of the control valve 13, which intersects the line section 12. In the zone of overlap with the line section 12, the stem part 14 delimits an annular space 22 in relation to the housing part 15. The space 22 is closed in the direction of the armature 17 interacting with the magnet coil, 16 by a plunger-like guide section 21 of the stem part 14. The space 21 can be closed in the opposite direction by means of a valve head 18 provided on the stem part 14.

When the control valve 13 is open, that is the valve head 18 is lifted off its seat, the annular space 22 is placed in communication with a chamber 19 situated in the low pressure system of the fuel supply so that the pump can draw in fuel during the suction stroke as the plunger 9 moves back. With the valve head 18 unseated, fuel is also pumped back to the low-pressure system when the plunger 9 is moved in the direction of compression.

The stem part 14 with the valve head 18 is biased by a spring 20 in the direction toward the open position shown in FIG. 2. When the magnet coil 16 is energized, the armature 22 is moved towards the magnet coil 16, whereby the control valve 13 is closed, as illustrated in FIG. 3. Depending on the energization of the magnet coil 16, it is also possible for the valve 13 to assume an intermediate position between the fully open and fully closed positions, allowing the respective line pressure and, correspondingly, the delivery rate and injection point of time to be modified. Injection with the control valve 13 closed is illustrated in FIG. 3.

Control valves based on the principle illustrated in FIGS. 2 and 3 are disclosed, for example, in WO 97/01 031 together with further details in conjunction with a plug-in pump.

Figure 5:
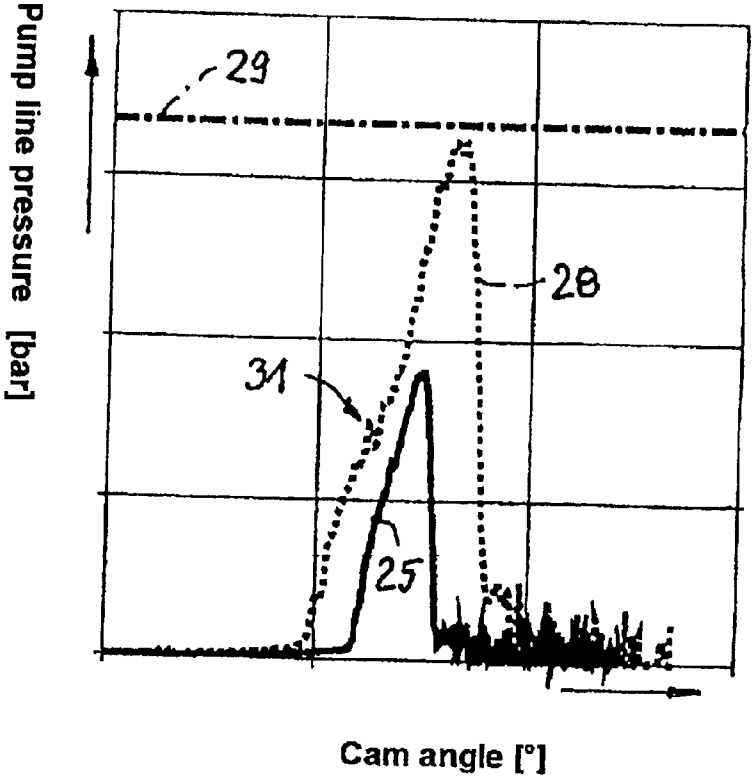
FIGS. 4 and 5 show diagrams in which the cam velocity, the travel of the magnetically operated control valve and the delivery pressure of the pump (that is, the line pressure) are plotted over the cam angle for a low engine speed and a higher, upper engine speed, the pressure build-up for the higher engine speed being reduced in the region of the longitudinal center of the rising flank of the pressure curve.
Figure 4:
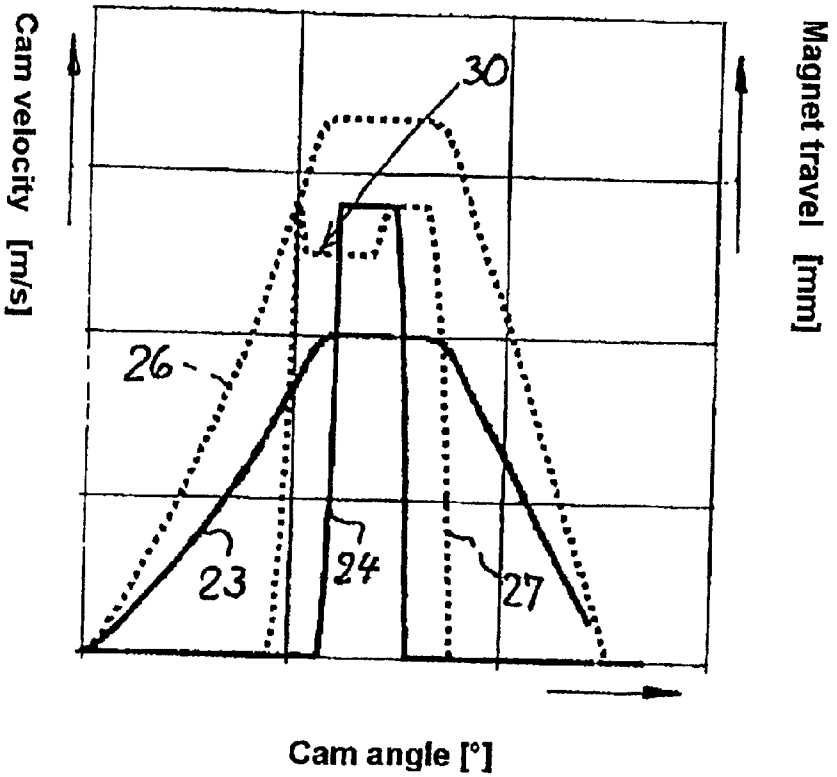

The increase in the level of the pressure profile over the engine speed without a corresponding rise in the maximum permissible injection pressure will be explained below with reference to FIGS. 4 to 7. FIGS. 4 and 5, on the one hand, and FIGS. 6 and 7, on the other hand, illustrate corresponding solutions in different forms of representation.

Figure 6:
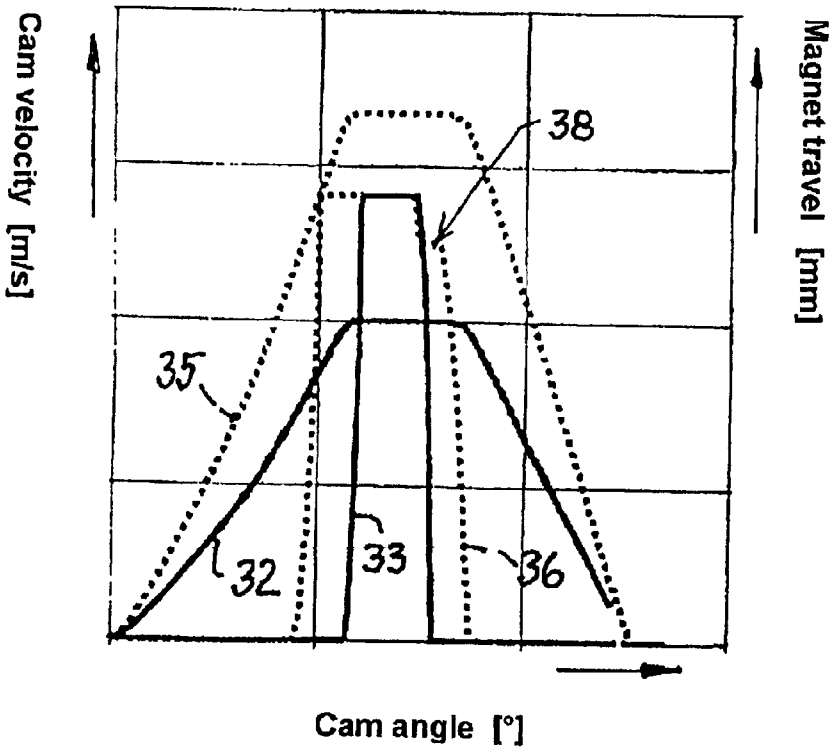

In FIG. 4 and similarly, in FIG. 6, the cam velocity and the magnet-initiated travel of the control valve are plotted over the cam angle for each pump stroke. The magnet-initiated travel starts from the fully open position of the control valve at a magnet travel position of 0 in accordance with FIG. 2. In FIG. 5, and similarly in FIG. 7, the delivery pressure of the pump is plotted as the pump line pressure over the cam angle, based on the maximum permissible injection pressure. The cam velocity, the magnet travel and the pump line pressure are each indicated by a solid line based on a predetermined lower to medium engine speed of about 1100 rpm and by a dotted line for a higher engine speed, namely a speed of 1800 rpm corresponding approximately to the rated speed of the internal combustion engine. The corresponding injection volume at the lower engine speed is about half that at the higher engine speed. In FIGS. 4 and 5, the plot for the cam velocity over the cam angle based on the low engine speed is indicated by numeral 23, that for the magnet travel by numeral 24 and that for the pump line pressure by numeral 25. Based on the hither engine speed, the cam velocity is indicated by numeral 26, the magnet travel by numeral 27 and the pump line pressure by numeral 28.

The starting point for the illustration in FIGS. 4 and 5 is the opened state of the control valve in accordance with FIG. 2. The control valve 13 is closed by energization of the magnet coil 16 (FIG. 3). In accordance with the profile of the cam velocity, this leads to a pressure curve as shown in FIG. 5.

These relationships are approximately the same for the low and the high engine speed, as a comparison of curves 23 to 25 and 26 and 28 will show.

At the higher engine speed with the conditions determined by the geometrical/mechanical configuration of the pump arrangement, the pump line pressure that would occur with an increased cam velocity 26 and a magnet travel 27 would exceed the dash-dotted line 29. The profile of pump line pressure curve would be approximately rectangular like the magnet travel 24. The dash-dotted line 29 indicates the maximum permissible injection pressure. To avoid excessive pump line pressure, the magnet travel 27 is reduced briefly over the cam angle, starting from the closed position of the control valve achieved with a fully energized magnet coil 16, such that the control valve 13 is again opened briefly, that is, it is opened again partially to counteract excessive rising of the pressure curve 28. The release of the magnet and the reduction in the magnet travel (droop in the magnet travel) are indicated at 20 in FIG. 4. As illustrated at 31 in FIG. 5, the brief opening of the valve leads to a reduction in the pressure build-up or a delayed pressure build-up over the cam angle, with the result that the pressure peak is reduced and the critical injection pressure as indicated by the dash-dotted line 29 is not exceeded.

Figure 7:
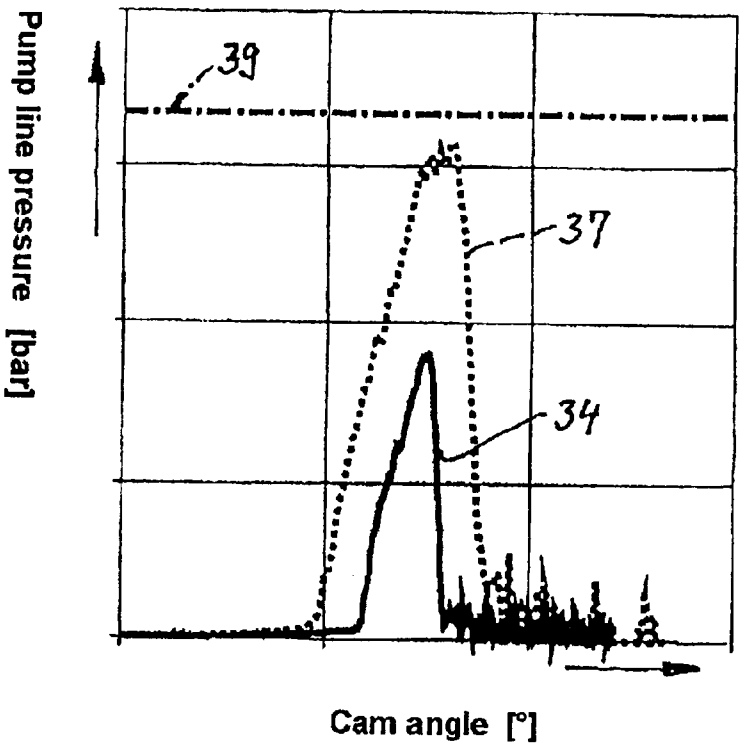
FIGS. 6 and 7 are illustrations corresponding to those in FIGS. 4 and 5, wherein the pressure build-up, illustrated by the pressure curve, is reduced for the higher engine speed in the region of the vertex of the pressure curve.

In the illustrations in FIGS. 6 and 7, which are analogous to those in FIGS. 4 and 5, the cam velocity is denoted by 32, the magnet travel by 33 and the pump line pressure by 34, based on the lower engine speed level, and respectively, by 35, 36 and 37 based on the higher engine speed level. The basic profile of the respective curves corresponds to that in FIGS. 4 and 5, and this also applies to the energizing time of the magnet coil 16. However, in departure from the exemplary embodiment in accordance with FIGS. 4 and 5, the energization of the magnet is now reduced not at the beginning of the valve closing phase, but at the end of the energizing phase, resulting in a correspondingly reduced magnet travel and a consequent partial opening of the control valve. This is illustrated at 38 in FIG. 6. The corresponding partial opening of the control valve 13 leads to a reduction in the pump line pressure in the final phase of the delivery stroke, as illustrated in FIG. 7, ensuring that its maximum does not exceed the maximum permissible injection pressure 39. On the other hand however, this method results in a steeper pressure build-up, as a comparison between FIGS. 5 and 7 shows, resulting in a wider profile for the curve 37 in comparison with the curve 28.

Overall, the method discussed involving a configuration for a theoretical load point, that is, above the rated-speed/full-load load point corresponding to the predetermined maximum permissible injection pressure, allows an increase in the delivery pressure in the lower engine speed and load range. Particular advantageous results, however, are achieved in the intermediate engine speed and load range, resulting in positive effects on soot and particulate emissions in this particularly critical range.

The invention thus proposes a method for operating a Diesel engine with a pump-line-nozzle injection system that permits the pressure level in the intermediate engine speed range to be raised in relation to a predetermined maximum permissible injection pressure without this maximum permissible injection pressure being exceeded in the upper engine speed range.

What is claimed is:

1. A method for operating a Diesel engine with a pump-line-nozzle fuel injection system, which includes for each individual cylinder a fuel injection nozzle supplied with fuel by a cam-driven pump, that is designed for achieving a maximum permissible injection pressure in a low engine speed range and capable of generating a triangular fuel pressure profile over the cam angle during each pump stroke, whereby fuel delivery volume increases with engine speed towards a design point, wherein an electric control valve situated in a connection to a low-pressure side controls the pressure of the fuel supplied to the fuel injection nozzle, and wherein the delivery pressure corresponding to the design point of said all cam-driven pump is above a maximum permissible injection pressure, said method comprising the step of operating said electronic control valve so as release fuel at the beginning of the fuel compression stroke to configure the pressure profile over the engine speed for a particular engine operating point below the maximum permissible injection pressure of the system.

2. A method according to claim 1, wherein the level of the pressure profile over the engine speed is reduced before the delivery pressure corresponding to the maximum permissible injection pressure is reached.

3. A method according to claim 2, wherein the level of the pressure profile over the engine speed is reduced above an intermediate engine speed range.

4. A method according to claim 1, wherein, when the delivery pressure corresponding to the maximum permissible injection pressure of the fuel injection system is reached, the pressure profile over the engine speed is limited to a pressure level corresponding to, or lower than, said delivery pressure.

5. A method according to claim 1, wherein the pressure build-up in each pump stroke is reduced in the region of the rising flank of the pressure curve.

6. A method according to claim 5 wherein the pressure build-up in each pump stroke is reduced in the region of the longitudinal center of the rising flank of the pressure curve.

7. A method according to claim 1, wherein the pressure build-up generated with each pump stroke is reduced in the region of the vertex of the pressure curve.

* * * * *